US006503361B1

(12) United States Patent
Nyui et al.

(10) Patent No.: US 6,503,361 B1
(45) Date of Patent: Jan. 7, 2003

(54) POLISHING METHOD AND POLISHING APPARATUS USING THE SAME

(75) Inventors: Masaru Nyui, Utsunomiya; Mikichi Ban, Miura, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/090,803

(22) Filed: Jun. 4, 1998

(30) Foreign Application Priority Data

Jun. 10, 1997 (JP) ..... 9-169557

(51) Int. Cl.[7] ..... C23F 1/04

(52) U.S. Cl. ..... 156/345.13; 438/692; 216/89

(58) Field of Search ..... 156/345; 451/287, 451/5, 8, 1, 6; 438/692, 8, 14, 16; 15/77; 34/277; 324/158.1; 209/37; 298/7; 69/34; 216/89

(56) References Cited

U.S. PATENT DOCUMENTS

| | | | | |
|---|---|---|---|---|
| 5,081,796 A | | 1/1992 | Schultz | 51/165 |
| 5,372,673 A | * | 12/1994 | Stager et al. | 156/626 |
| 5,393,370 A | * | 2/1995 | Ohta et al. | 156/345 |
| 5,555,474 A | * | 9/1996 | Ledger | 356/381 |
| 5,609,511 A | | 3/1997 | Moriyama et al. | 451/5 |
| 5,672,091 A | | 9/1997 | Takahashi et al. | 451/6 |
| 5,695,601 A | * | 12/1997 | Kodera et al. | 156/345 |
| 5,888,120 A | * | 3/1999 | Doran | 451/41 |
| 5,948,203 A | * | 9/1999 | Wang | 156/345 |
| 5,958,268 A | * | 9/1999 | Engelsberg et al. | 219/121.84 |
| 6,110,008 A | * | 8/2000 | Fujita et al. | 451/8 |

FOREIGN PATENT DOCUMENTS

| | | |
|---|---|---|
| EP | 0 738 561 A1 | 10/1996 |
| EP | 0 806 266 A2 | 11/1997 |
| JP | 8-174411 | 7/1996 |

* cited by examiner

*Primary Examiner*—Gregory Mills
*Assistant Examiner*—Rudy Zervigon
(74) *Attorney, Agent, or Firm*—Fitzpatrick, Cella, Harper & Scinto

(57) ABSTRACT

This specification discloses a polishing method of polishing the surface of a film layer provided on the surface of a substrate by polishing means with both of them driven relative to each other, having a position detecting step of detecting a predetermined position on the surface of the film layer, a first measuring step of applying momentary light from a light source to the predetermined position, and detecting the light beam from the predetermined position by a light receiving element to thereby measure the film thickness at the predetermined position, and a controlling step of controlling the polishing state by using data obtained in the first measuring step. The specification also discloses a polishing apparatus using such polishing method.

19 Claims, 5 Drawing Sheets

POLISHING METHOD AND POLISHING APPARATUS USING THE SAME

BACKGROUND OF THE INVENTION

1. Field of the Invention

This invention relates to a polishing method for use in chemically and mechanically polishing and flattening the surface of a substrate such as a wafer having dielectric material layers or the like laminated, in a manufacturing process for a semiconductor device, and a polishing apparatus using the same, and is suitable, for example, in the lithography step of accurately detecting the polishing terminating point of the polishing step for an insulating film layer (film layer) applied to a silicon substrate and efficiently setting the film thickness of the insulating film layer to a predetermined range to thereby obtain a highly integrated semiconductor device.

2. Related Background Art

In recent years, with the tendency of semiconductor devices toward higher integration, the tendency of circuit patterns toward minuteness and the tendency of the device structure toward three dimensions have been advancing. If the numerical aperture of a projection optical system is made great to achieve the higher integration of the semiconductor device, the depth of focus of the projection optical system correspondingly becomes shallow. Therefore, it is important to polish the surface of the semiconductor device to thereby remove any level-difference portion and any uneven portion and flatten the surface, and apply photoresist onto the flattened surface, and projection-expose it to thereby achieve high resolution.

Also, it is an important factor for making the irregularity of the inter-layer capacity and the depth of via-holes constant to polish an insulating film layer provided on a silicon substrate to thereby provide a film layer of a uniform thickness.

A chemical-mechanical polishing method has heretofore been proposed as a flattening technique for removing the level difference portion and uneven portion of the surface of a semiconductor device to thereby flatten the surface.

In the chemical-mechanical polishing, it is necessary to appropriately control the polishing rate, the slurry density in polishing liquid and the temperature of a polishing surface in and to make the polishing efficient. If this control is defective, the insulating film provided on the silicon substrate will not assume a predetermined film thickness and the surface cannot be flattened and the aforementioned depth of focus cannot be secured and a reduction in the reliability of wiring will be caused, and also, the phenomena known as dishing and thinning due to the difference in polishing speed between the insulating film and an electrode wiring portion will occur to thereby cause short-circuiting or the like between via-holes.

Therefore, when the surface of a substrate such as a wafer having dielectric material layers or the like laminated is to be polished and flattened, it becomes important to appropriately judge the polishing terminating point and flatten the surface without removing the material of the lower layer.

For example, a terminating point detecting method of monitoring on the spot the film thickness of the surface of a substrate such as a wafer having dielectric material layers or the like laminated which is the object of polishing, and yet grasping the level of the flattening of the whole or localized part of the surface of the substrate such as the wafer and judging the optimum portion for terminating the polishing, becomes important in the chemical-mechanical polishing.

As the method of detecting the polishing terminating point, use has heretofore been made, for example, of a method of deducing the amount of polishing from the polishing time or a method of obtaining any change in polishing resistance from a change in the electric current of a polishing stool driving motor.

The method of obtaining the amount of polishing from the polishing time as a method of detecting the terminating point of polishing in the flattening of the surface of a semiconductor device by chemical-mechanical polishing requires to control conditions such as the pressing force of the semiconductor device, the degree of wear of a polishing pad, the density of slurry in polishing liquid and the temperature of a polishing surface constantly and therefore, it is difficult to detect the terminating point accurately.

Also, the method of obtaining any change in polishing resistance from a change in the electric current of a polishing stool driving motor requires to separate a signal waveform and noise from each other highly accurately and therefore, it is difficult to detect the terminating point accurately.

SUMMARY OF THE INVENTION

The present invention has as its first object the provision of a polishing method suitable, when chemically-mechanically polishing and flattening the surface of a substrate such as a wafer having dielectric material layers or the like laminated, for utilizing an appropriately designed film thickness measuring method or/and film thickness measuring means to thereby directly monitor the film thickness of the surface on the spot and measure the film thickness distribution on the whole or localized part of the surface, and optimize the polishing conditions from the measured information and efficiently flatten the surface of a semiconductor device, and enhance the detection accuracy of a polishing terminating point and manufacture a semiconductor device having a high degree of integration, and a polishing apparatus using the same.

Other objects of the present invention will become apparent from the following detailed description of the preferred embodiments of the invention.

DESCRIPTION OF THE PREFERRED EMBODIMENTS

Figure 1:
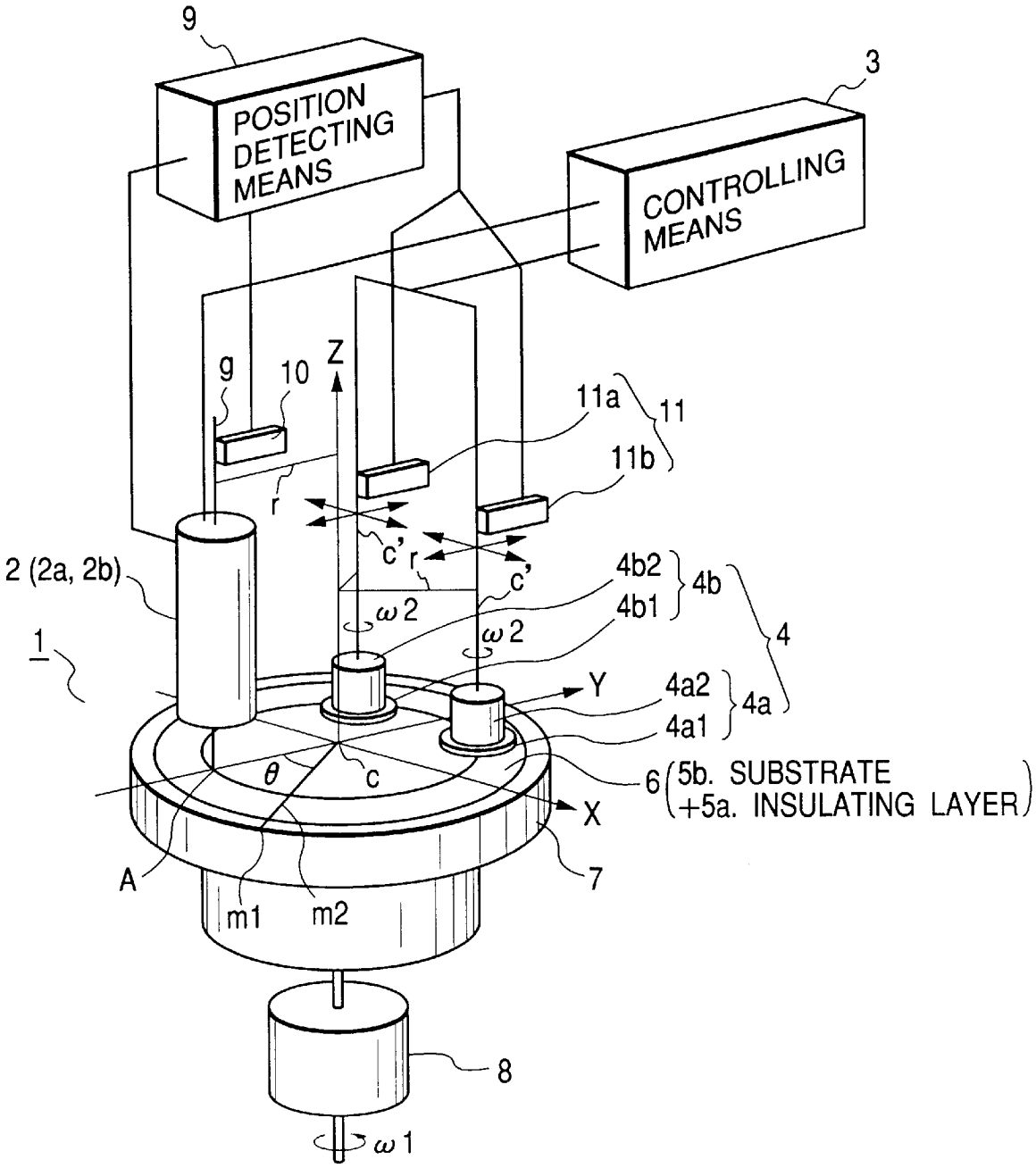
FIG. 1 is a schematic view of the essential portions of Embodiment 1 of the polishing apparatus of the present invention.

FIG. 1 is a schematic view of the essential portions of Embodiment 1 of the polishing apparatus (chemical-mechanical polishing apparatus) of the present invention, and shows a state in which an insulating film layer 5*a* on a substrate 5*b* which is a workpiece 6 is being polished by polishing means 4.

In FIG. 1, the reference numeral 2 designates film thickness measuring means. The film thickness measuring means 2 according to the present embodiment which will hereinafter be described comprises at least one of first film thickness measuring means 2*a* for measuring the absolute value of the film thickness at a position A on the insulating film layer 5*a* on the substrate 5*b* and second film thickness measuring means 2*b* for measuring film thickness information such as the film thickness difference in an area B around the position A with the absolute value of the film thickness at the position A as the reference and the average value of the film thickness.

Figure 2:
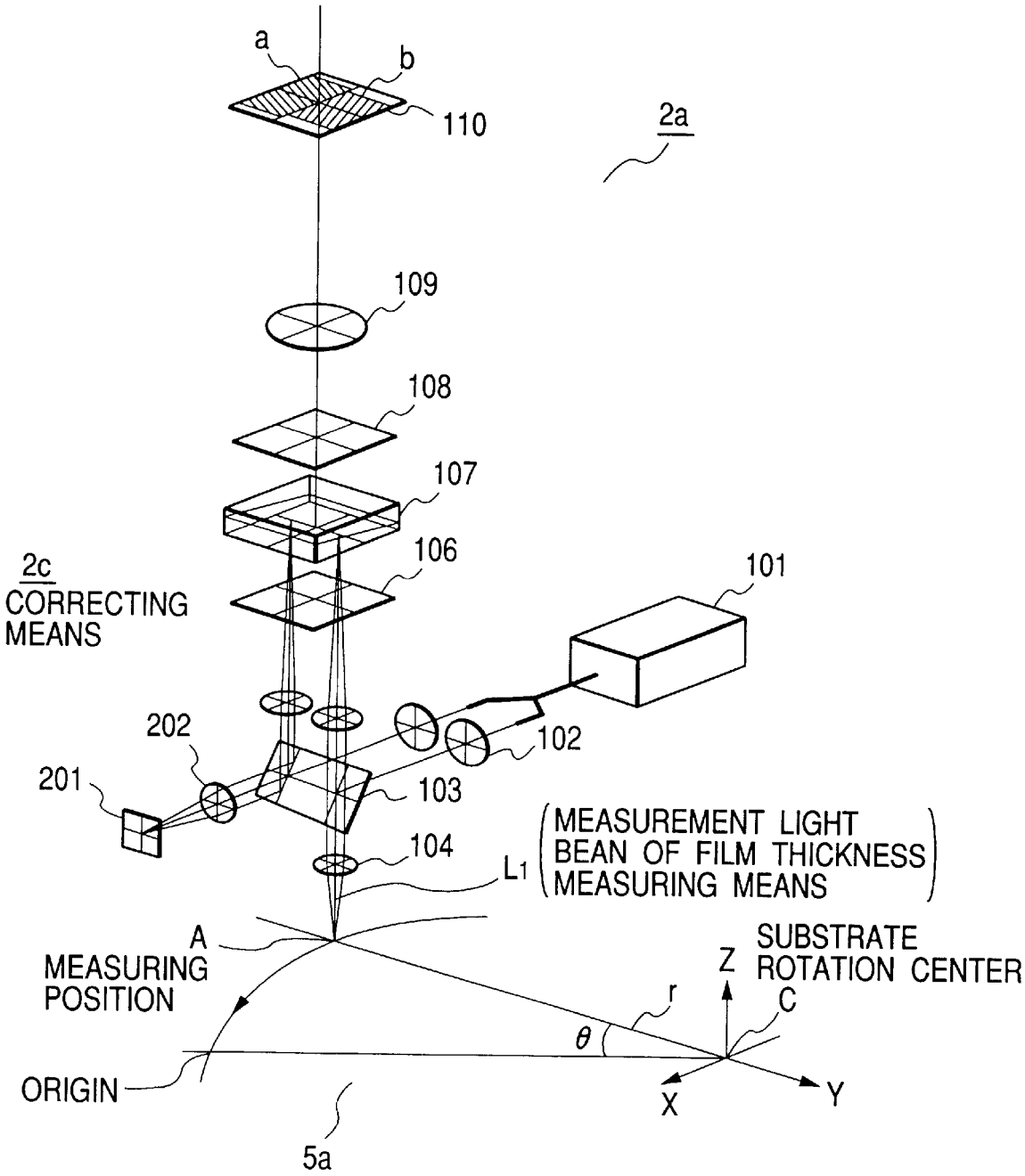
FIG. 2 is a schematic view of the essential portions of film thickness measuring means in Embodiment 1 of the polishing apparatus of the present invention.

In Embodiment 1 shown in FIG. 2, there is shown a case where the first film thickness measuring means 2*a* is used as the film thickness measuring means 2.

Figure 3:
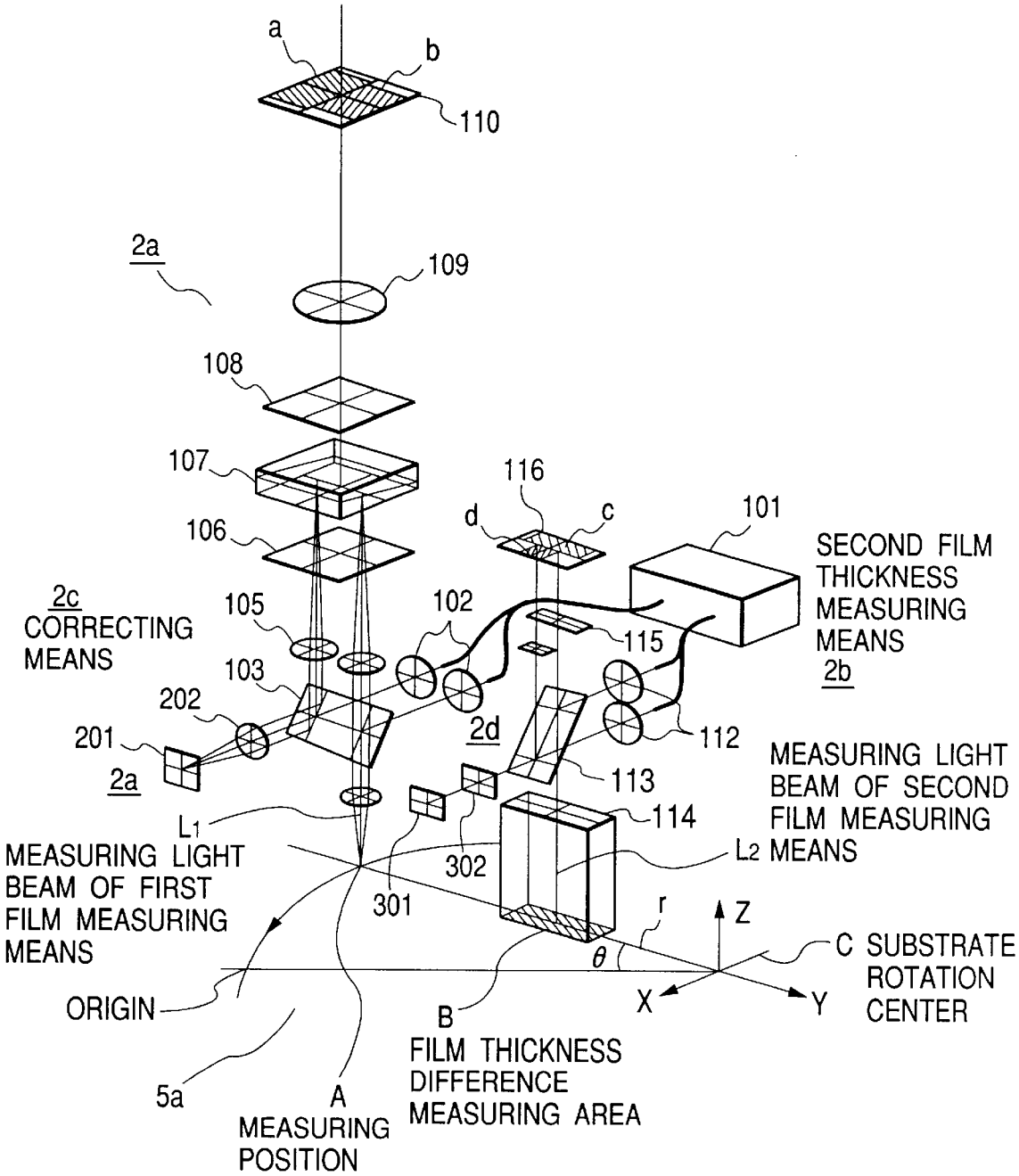
FIG. 3 is a schematic view of the essential portions of film thickness measuring means in Embodiment 2 of the polishing apparatus of the present invention.

In Embodiment 3 shown in FIG. 3, there is shown a case where the first film thickness measuring means 2*a* and the second film thickness measuring means 2*b* are used as the film thickness measuring means 2.

FIG. 2 shows a state in which the absolute value of the film thickness at a predetermined measuring position A on the insulating film surface 5*a* is being measured by the first film thickness measuring means 2*a* by the utilization of momentary light such as flashlight.

In FIG. 1, the reference numeral 1 denotes the chemical-mechanical polishing apparatus. FIG. 1 shows the manner in which the surface (substrate surface) of the workpiece 6 is polished by two partial polishing tools (polishing means) 4. The workpiece 6 comprises a construction in which an insulating film layer (film layer) 5*a* is formed on a silicon substrate 5*b*, and is held by a substrate holder 7. The substrate holder 7 holds the workpiece 6 and is rotated at an angular velocity ω1 about a rotary shaft C by driving means (not shown).

In FIG. 1, the rotary shaft C is defined as the Z-axis and a plane orthogonal thereto is defined as X, Y plane. The reference numeral 8 designates a rotary encoder which detects the rotation information of the rotary shaft C. The reference numeral 2 denotes the film thickness measuring means which comprises a construction shown in FIG. 2 and which measures the absolute value of the film thickness at the predetermined position A on the insulating film layer 5*a* on the substrate 5*b* by the first film thickness measuring means 2*a*.

The reference numeral 3 designates controlling means which controls the terminating point of the polishing step for the workpiece 6 or whether the polishing step should be continued, on the basis of the result of the detection of the surface information of the workpiece 6.

The reference numeral 4 (4*a*, 4*b*) denotes a partial polishing tool (polishing means). The partial polishing tool has a polishing pad (4*a*1) and a holder (4*a*2) for holding the polishing pad (4*a*1), and is rotated at an angular velocity ω2 about a rotary shaft C' by driving means (not shown).

In FIG. 1, there is shown a case where the insulating film layer 5*a* on the silicon substrate 5*b* is partially polished by the two partial polishing tools 4*a* and 4*b*. More than two partial polishing tools 4 may be used.

In the present embodiment, as shown, the polishing opening in the polishing pad (4*a*1) is smaller than the polished surface (insulating film layer) 5*a* of the workpiece 6. Thereby, partial polishing is effected. The partial polishing tool 4 (4*a*, 4*b*) is at a predetermined distance in the X-axis direction from the Z-axis as shown, and is movable by a predetermined distance on the X-axis.

In the present embodiment, a scrubber (not shown) is provided to thereby eliminate slurry or the like adhering to the insulating film layer 5*a* when the film thickness is measured.

Also, a water supply nozzle (not shown) for the supply of pure water is provided to thereby discharge the pure water to the surface to be worked (the insulating film layer) 5*a* and eliminate any slurry, dust, etc. adhering thereto, thus facilitating the highly accurate detection of the film thickness of the workpiece by the film thickness measuring means 2. The reference numeral 9 designates position detecting means which measures the position information on the insulating film layer 5*a*. The reference numeral 10 denotes a linear encoder, and the reference numeral 11 (11*a*, 11*b*) designates a two-axis linear encoder.

In the present embodiment, when the surface of the insulating film layer 5*a* is to be polished, the partial polishing tool 4 is rotated about the rotary shaft C' and is rotated about the rotary shaft C of the substrate holder 7 and both of them are driven relative to each other, and the slurry including a polishing material is caused to flow out from a nozzle (not shown) onto the surface of the workpiece 6 while the relative positive of both in X direction and Y direction is displaced as required, and the slurry is uniformly supplied to the interface between the insulating film layer 5*a* and the polishing pad.

At this time, polishing is effected with the pressure between the insulating film layer 5*a* and the partial polishing tool 4, the ratio of the number of revolutions therebetween and the amount of slurry supplied appropriately selected. Thereby, the insulating film layer 5*a* formed on the silicon substrate 5*b* is partially polished by the partial polishing tool 4 to thereby achieve the flattening of the surface thereof.

After partial polishing is effected for a preset time, the absolute value of the film thickness at the position A on the insulating film layer 5*a* is measured by the first film thickness measuring means 2*a* shown in FIG. 2 by the use of a method which will be described later.

In the present embodiment, design is made such that the film thickness information of the insulating film layer 5*a* of the workpiece 6 can be measured by utilizing momentary light even when that layer is being polished, thereby achieving an improvement in throughput.

On the basis of an output signal obtained from the film thickness measuring means 2*a*, the film thickness of the insulating film layer 5*a* is found by the controlling means 3. At this time, the controlling means 3 judges whether the film thickness of the insulating film layer 5*a* at a predetermined position is within a preset range.

When the film thickness is within the present range, the controlling means judges that polishing is at the terminating point, and stops the polishing step. When not so, the controlling means controls so as to continue the polishing step again. The controlling means 3 stops the polishing step when it judges during the polishing step that the film thickness of the insulating film layer 5*a* at the predetermined position is not within the preset range (for example, when the insulating film layer has been polished too much and has become too thin). At this time, the controlling means judges that the workpiece 6 is a substandard article.

The specific construction and operation of the present embodiment will now be described in succession.

Description will first be made of a detecting method (position detecting step) for positional information as to what position on the insulating film layer 5*a* is being measured by the film thickness measuring means 2*a*.

(a1) About the Detecting Method for the Predetermined Position A (a1-1) When the substrate 5*b* is to be mounted on and held by the substrate holder 7, the reference mark m1 of the substrate holder 7 and a mark m2 formed on the substrate 5*b* are brought into coincidence with each other. The position of this mark m1 corresponds to the origin position of the rotary encoder 8 connected to the substrate holder 7.

(a1-2) Let it be assumed that the predetermined position A on the substrate 5*b* at which the film thickness is measured is at an angle θ from this origin position and at a distance r from the center of rotation C of the substrate 5*b*.

(a1-3) The position detecting means 9 confirms this position A, and controls the measurement reference axis g of the first film thickness measuring means 2*a* by the use of the linear encoder 10 so as to become the position at the distance r from the center of rotation C of the substrate 5*b*.

(a1-4) Film thickness measurement is commanded at a position whereat the output of the rotary encoder 8 becomes θ.

The first film thickness measuring means 2*a* in the present embodiment uses momentary light to measure the absolute value of the film thickness at the predetermined position A on the workpiece 6 which is being rotated.

Description will now be made of a measuring method for the absolute value of the film thickness at the measuring position by the first film thickness measuring means 2*a*.

(a2) About the Film Thickness Measuring Method of the First Film Thickness Measuring Means 2*a*

(a2-1) During the film thickness measurement, pure water or the like is discharged by a nozzle to the insulating film layer 5*a* on the substrate 5*b* which is the workpiece, and eliminates any slurry, dust, etc. adhering thereto, and then the film thickness is measured.

(a2-2) The first film thickness measuring means 2*a* uses a white interference system. White light emitted from a momentary light source (first light source) 101 emitting momentary light such as flashlight is condensed and applied as a measurement light beam L1 to a particular measuring position A on the insulating film layer 5*a* via a condenser lens 102, a half mirror (HM) 103 and an objective lens 104.

(a2-3) The reflected light beam from the measuring position A enters a Wallaston prism 107 as a double-refractive prism through the objective lens 104, the half mirror (HM) 103, an imaging lens 105 and a polarizing filter 106, and is separated into P- and S-polarized waves and is tilted, and enters a CCD camera 110 through a polarizing filter 108 and a relay lens 109.

The relation between the output signal from the CCD camera (first light receiving element) 110 at this time and the film thickness at the measuring position A is as follows. Two light beams reflected by the surface of the insulating film layer 5*a* and the boundary surface between the insulating film layer 5*a* and the substrate 5*b* are separated into P- and S-polarized lights and the wave fronts thereof are tilted in discrete directions by the Wallaston prism 107, and the interval between interference fringes created on the portion of the line of intersection between the wave front of the P-polarized light reflected from the surface and the wave front of the S-polarized light reflected from the boundary surface, or the portion of the line of intersection between the wave front of the S-polarized light reflected from the surface and the wave front of the P-polarized light reflected from the boundary surface is found by calculating the peak-to-peak distance of the distribution of the quantity of light on the CCD camera 110 from the number of elements to thereby measure the absolute film thickness value.

The absolute film thickness value d is $d=y\times\sin a/n$ when the peak interval is y and the refractive index of the material of the film layer 5*a* is n and the tilt angle of the wave fronts of the P-polarized light and S-polarized light by the Wallaston prism is a.

In the present embodiment, at the position detecting step, momentary light is applied to the measuring position A in synchronism with a position at which the output from the rotary encoder 8 becomes an angle θ. Thereby, the film thickness measurement at the measuring position A is effected. By such a film thickness measuring method, highly accurate measurement is effected in such a manner that even if the measuring position A moves during the polishing of the surface of the film layer 5*a*, the momentary light is not applied to the outside of the range of the measuring position A.

Also, correcting means 2*c* for correcting the measured film thickness value is provided on the first film thickness measuring means 2*a*, and the correcting means 2*c* contains therein a sample 201 for correction of which the film thickness is known, and uses in common at least the momentary light source 101 of the first film thickness measuring means 2*a* and the light receiving element (CCD camera) 110 to effect the film thickness measurement and the measurement for correction in synchronism with each other.

That is, the light beam from the momentary light source 101 is caused to enter the sample 201 for correction through the condenser lens 102, the half mirror 103 and a lens 202 in succession. Then, the light beam from the sample 201 for correction is caused to enter the area b of the CCD camera 110 through the lens 202, the half mirror 103, the imaging lens 105, the polarizing filter 106, the Wallaston prism 107, the polarizing filter 108 and the lens 109 in succession.

As described above, on the CCD camera 110, the light receiving element of the film thickness measuring system uses an area a, and the correcting system uses the area b.

The film thickness measuring method of this correcting means 2*c* adopts the same method as that of the film thickness measuring system. When the result of the measurement by the first film thickness measuring means 2*a* is to be corrected on the basis of the result of the measurement by this correcting means, the influence of the slurry or the like of polishing adhering to the sample 201 for correction to thereby deteriorate the accuracy of correction is prevented by the correcting means containing the sample 201 for correction therein, as compared with a case where the sample for correction is externally attached to the periphery of the workpiece 6 held by the substrate holder 7, and also the time for the first film thickness measuring means 2*a* to be moved to the location of the sample for correction during correction is omitted. Also, the momentary light source 101 and the light receiving element (CCD camera) 110 of the first film thickness measuring means 2*a* are used in common and the film thickness measurement and the measurement of correction are effected in synchronism with each other, whereby as compared with a case where they are effected independently of each other, the measurement error by a change or the like in the level of a dark current attributable to the light receiving element and the correction error when a change in the spectral distribution and the light emission intensity of the momentary light source occurs are reduced to the utmost.

Here, the white interference system has been used as the first film thickness measuring means 2*a*, but alternatively, a spectral reflectance measuring system or an ellipsometer may be used.

Description will now be made of the film thickness measuring means 2 according to the FIG. 3 embodiment of the present invention. In this embodiment, there is shown a case where the absolute film thickness value at the measuring position A is measured by first film thickness measuring means 2*a* and with the absolute film thickness value at this measuring position A as the reference, film thickness information such as the film thickness difference in the surrounding area B is measured by second film thickness measuring means 2*b* utilizing the momentary light.

In FIG. 3, the film thickness measuring method of the first film thickness measuring means 2*a* is the same as that of the first film thickness measuring means 2*a* of FIG. 2.

Here, description will be made of a method of measuring the film thickness difference from the absolute film thickness value at the measuring position in the area B around the measuring position A by the second film thickness measuring means 2*b*.

(a3) About the Film Thickness Measuring Method of the Second Film Thickness Measuring Means 2*b*

(a3-1) A film thickness difference measuring area B for measuring what degree of difference the surroundings of the position A at which the absolute film thickness value has been measured have from that absolute film thickness value is set.

(a3-2) The second film thickness measuring means 2*b* has an optical system for reducing and projecting this film thickness difference measuring area B onto a color CCD 116. First, white light (momentary light) emitted from a momentary light source 101 as a second light source which is the same as the first light source is applied as a measurement light beam L2 to the film thickness difference measuring area B of the insulating film layer 5*a* via a condenser lens 112, a half mirror (HM) 113 and an objective lens 114. The reflected light beam from the film thickness difference measuring area B is reduced and projected onto the color CCD (second light receiving element) 116 via the objective lens 114, the half mirror (HM) 113 and a lens 115.

Figure 4:
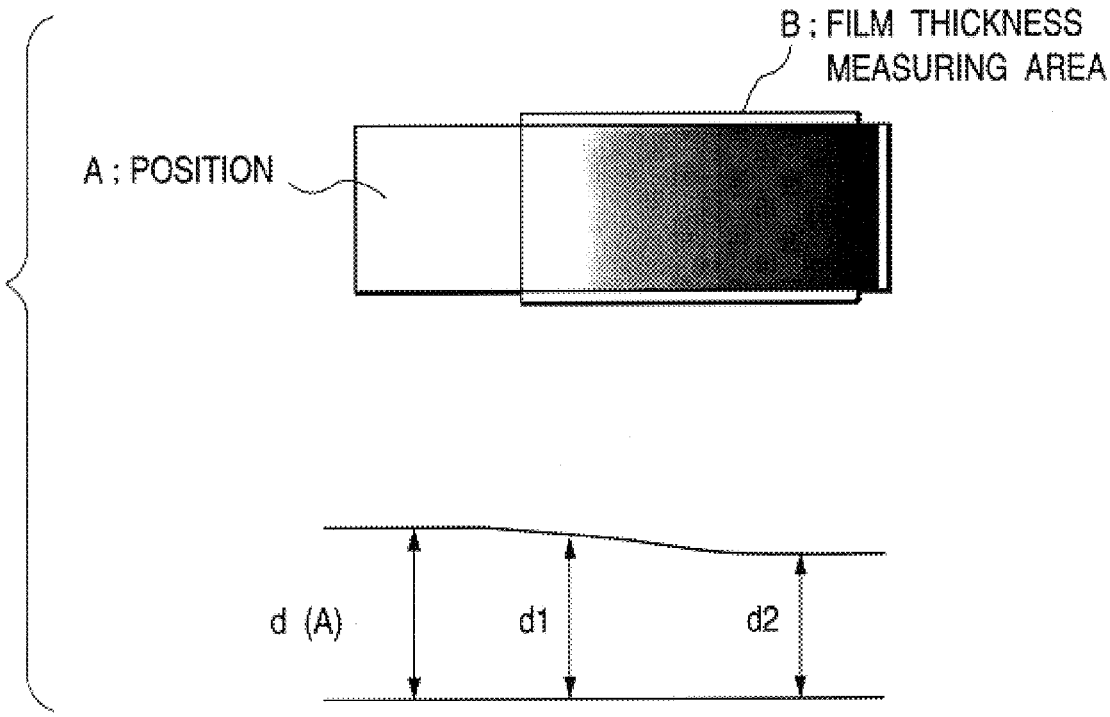
FIG. 4 shows that in the film thickness measuring means in Embodiment 2 of the polishing apparatus of the present invention, the film thickness difference is represented as the distribution of an interference color.

(a3-3) When that area is defined as c, the interior of the area c presents an interference color conforming to the film thickness difference with respect to the absolute film thickness value d(A) at the position A as will be described next. In FIG. 4, what is a wavelength λA which strengthens by interference when the film thickness is d(A) is found by the calculation of the following expression, and the interference color at the position A is determined:

$$2nAd(A)=N\lambda A \text{ (}N\text{ being an integer)}$$

(a3-4) Assuming that the distribution of the interference color in an area c is λ1 to λ2 in terms of the expression of wavelength, as compared with the result of the absolute film thickness value d(A), the distribution d1 to d2 of the film thickness difference in the area c is calculated from $$d\mathbf{1}=N\lambda 1/2n\mathbf{1}$$

$$d\mathbf{2}=N\lambda 2/2n\mathbf{2}.$$

In the present embodiment, at the position detecting step, the momentary light is applied to the measuring area B in synchronism with a position at which the output from the rotary encoder 8 becomes an angle θ. Thereby, the film thickness measurement in the measuring area B is effected. By such a film thickness measuring method, highly accurate measurement is effected in such a manner that even if the measuring area B is moving during the polishing of the surface of the film layer 5*a*, the momentary light is not applied to the outside of the range of the measuring area B.

As described above, the present embodiment has the film thickness distribution measuring step of providing one or more of the first and second film thickness measuring means 2*a* and 2*b*, measuring the absolute value of the film thickness and the film thickness difference, and obtaining the film thickness distribution of the insulating film layer 5*a* of the whole of the substrate 5*b*.

In the present embodiment, as in Embodiment 1, correcting means 2*d* for correcting the measured value of the film thickness is provided on the second film thickness measuring means 2*b*, and the correction means 2*d* contains therein a sample 301 for correcting of which the film thickness is known, and uses in common the momentary light source 101 and the light receiving element (color CCD camera) 116 of the second film thickness measuring means 2*b* to effect the measurement by the second film thickness measuring means 2*b* and the measurement of the correction in synchronism with each other.

On the color CCD camera 116, the light receiving element of the second film thickness measuring means 2*b* uses an area c and the correcting system uses an area d.

The film thickness measuring method of this correcting means 2*d* adopts the same method as that of the second film thickness measuring means 2*b*.

When the result of the measurement by the second film thickness measuring means 2*b* is to be corrected on the basis of the result of the measurement by this correcting means 2*d*, the influence of the slurry or the like of polishing adhering to the sample for correction to thereby deteriorate the accuracy of correction is prevented by the correcting means containing the sample 301 for correction therein, as compared with a case where the sample for correction is externally attached to the periphery of the workpiece 6 held by the substrate holder 7, and also the time for the second film thickness measuring means 2*b* to be moved to the location of the sample 301 for correction during correction can be omitted. Also, the momentary light source 101 and the light receiving element (color CCD camera) 116 of the second film thickness measuring means 2*b* are used in common and the second film thickness measurement and the measurement of correction are effected in synchronism with each other, whereby as compared with a case where they are effected independently of each other, the measurement error by a change or the like in the level of a dark current attributable to the light receiving element and the correction error when a change in the spectral distribution and the light emission intensity of the momentary light source occurs are reduced to the utmost.

Besides the measuring method of the first and second film thickness measuring means 2*a* and 2*b* described above, when the workpiece is one simple in film layer structure like a monitor wafer, use can also be made of a method using a momentary light beam of a particular wavelength selected from a semiconductor laser or a white light source, using a photosensor as the light receiving element of the first film thickness measuring means, and using a black-and-white CCD camera as the light receiving element of the second film thickness measuring means.

In such case, with the signal output from the photosensitive of the first film thickness measuring means as the reference, the distribution of the signal output of the black-and-white CCD camera in the second film thickness measuring means corresponding to the aforementioned film thickness difference measuring area B is compared to thereby calculate any change in the film thickness of the workpiece.

Description will now be made of the control of the polishing step in the present embodiment.

(a4) About the Control of the Polishing Means and Polishing Conditions (a4-1) By the use of a linear encoder 11 for two axes from the position detecting means 9, the polishing means (partial polishing tool) 4 is moved to a position at a distance r from the Z-axis. This polishing means 4 is rockable about the X-axis and the Y-axis while being rotated.

(a4-2) On the basis of the information from the first and second film thickness measuring means 2*a* and 2*b*, the difference from the film thickness distribution which is the final target is compared, and when the difference is not within the range of a predetermined value, the polishing conditions are corrected by the value of the difference and the polishing means 4 is controlled so as to re-polish.

(a4-3) When this difference comes into the range of the predetermined value, the polishing work is stopped.

Figure 5:
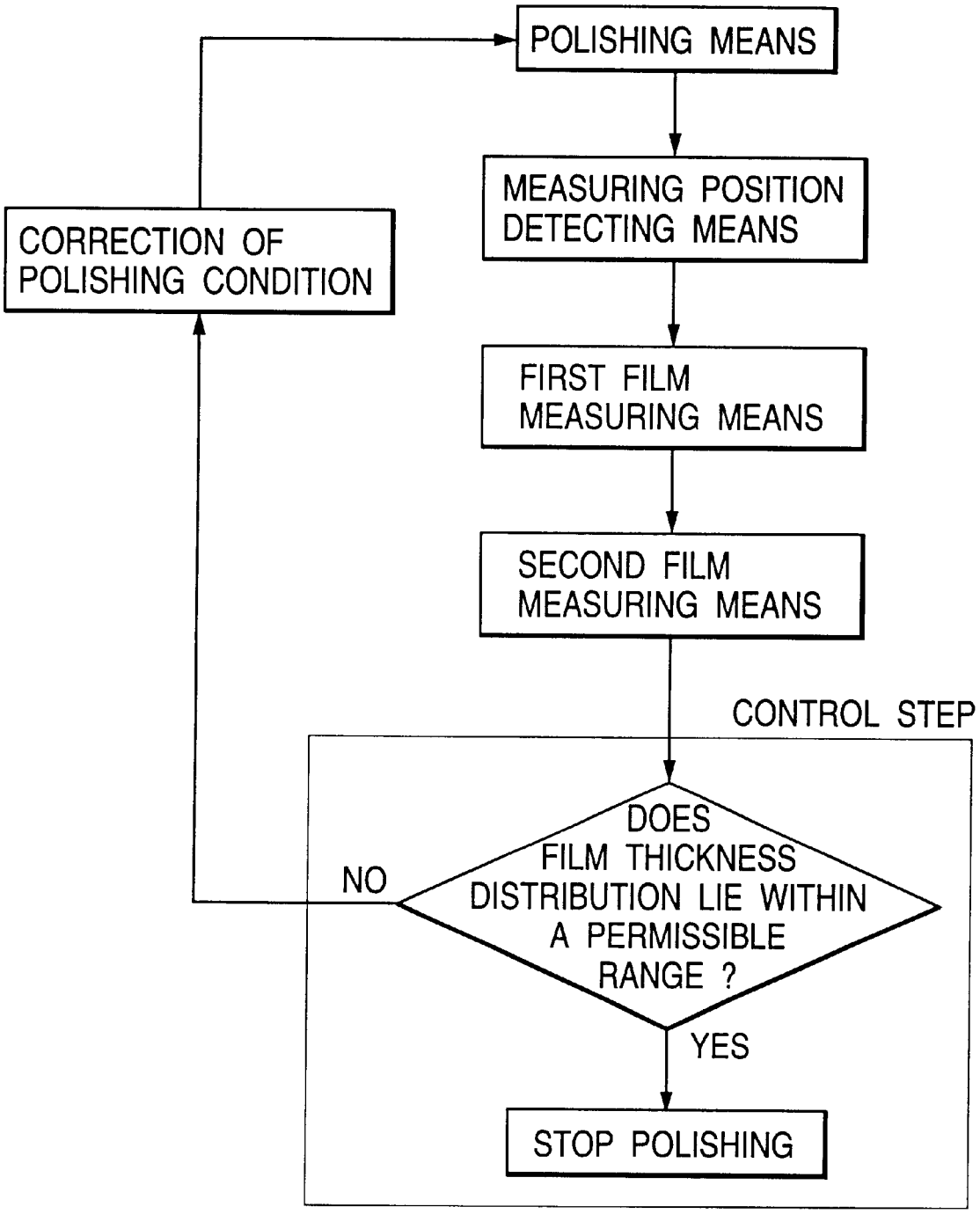
FIG. 5 is a flow chart of the operation in the film thickness measuring means in Embodiment 1 of the polishing apparatus of the present invention.

FIG. 5 shows a flow chart of the operations of the various means in the present embodiment.

As described above, in the present embodiment, the insulating film layer 5*a* of the silicon substrate 5*b* is polished and flattened by the polishing means, whereby the whole of the area of the insulating film layer 5*a* which is the object when projected and exposed comes into the depth of focus of the projection optical system. Also, the irregularity of the inter-layer capacity is prevented in such a manner that the film thickness of the insulating film layer 5*a* is within a predetermined range, and the depths of via-holes are unified.

What is claimed is:

1. A polishing method for polishing a surface of a film layer provided on a surface of a substrate by polishing means driven relative to the substrate, comprising:

a position detecting step of detecting a first position on said surface of said film layer;

a first measuring step of applying a momentary light from a light source to said first position, and detecting a light beam from said first position by a light receiving element to thereby measure a film thickness at said first position; and a controlling step of controlling a polishing condition by using data obtained at said first measuring step.

2. A method according to claim 1, wherein said first measuring step further comprises a correcting step for correcting a value of said measured film thickness, and said correcting step has the measurement of the film thickness of a sample for correction of which the film thickness has been known, executed by using said light source and said light receiving element used in said first measuring step and in synchronism with said first measuring step.

3. A method according to claim 1 wherein in said controlling step, the polishing is stopped when at least one of the film thickness and a film thickness distribution of said film layer comes into a preset range.

4. A method according to claim 1, wherein operations of said first measuring step and said controlling step are performed during polishing of surface of said film layer by said polishing means.

5. A polishing method for polishing a surface of a film layer provided on a surface of a substrate by polishing means driven relative to the substrate, comprising:

a position detecting step of detecting a first position on a surface of said film layer;

a first measuring step of applying a momentary light from a first light source to said first position, and detecting a light beam from said first position by a first light receiving element to thereby measure a film thickness at said first position;

a second measuring step of applying a momentary light from a second light source to an area including or adjacent to said first position, and detecting the light beam from said area by a second light receiving element to thereby measure a film thickness information of said area;

a film thickness distribution measuring step of obtaining a film thickness distribution of said film layer by using the results of measurement obtained in said first measuring step and said second measuring step; and a controlling step of controlling whether or not said polishing should be continued, from data obtained in said film thickness distribution measuring step.

6. A method according to claim 5, wherein at least one of said first measuring step and said second measuring step further comprises a correcting step for correcting a value of said measured film thickness, and said correcting step performs measurement of a film thickness of a sample for correction of which the film thickness has been known, executed by using said light source and said light receiving element used in said at least one measuring step and in synchronism with said at least one measuring step.

7. A method according to claim 5, wherein said film thickness information measured at said second measuring step is a film thickness difference or an average value of the film thickness.

8. A method according to claim 5, wherein in said controlling step, said polishing is stopped when said film thickness distribution of said film layer comes into a preset range.

9. A method according to claim 5, wherein operations of said first and second measuring steps, said film thickness distribution measuring step and said controlling step are performed during polishing of surface of said film layer by said polishing means.

10. An apparatus for polishing a surface of a film layer provided on a surface of a substrate, comprising:

polishing means driven relative to said substrate to thereby polish;

a position detecting system for detecting a first position on said surface of said film layer;

a first measuring system having a light source emitting momentary light and a light receiving element, said first measuring system applying a momentary light from said light source to said first position on the basis of detection by said position detecting system, and detecting a light beam from said first position by said light receiving element to thereby measure a film thickness at said first position; and a controlling system for controlling said polishing means by using data obtained by said first measuring system.

11. An apparatus according to claim 10, wherein said first measuring system has correcting means for correcting a value of said measured film thickness, and said correcting means performs measurement of a film thickness of a sample for correction of which the film thickness has been known executed by using said light source and said light receiving element and in synchronism with measurement of said film thickness at said first position.

12. An apparatus according to claim 10, wherein said controlling system stops polishing when at least one of the film thickness and the film thickness distribution of said film layer comes into a preset range.

13. An apparatus according to claim 10, wherein operations of said first measuring system and said controlling system are performed during polishing of surface of said film layer by said polishing means.

14. An apparatus for polishing a surface of a film layer provided on a surface of a substrate, comprising:

polishing means driven relative to said substrate to thereby polish;

a position detecting system for detecting a first position on said surface of said film layer;

a first measuring system having a first light source emitting a momentary light and a first light receiving element, said first measuring system applying said momentary light from said first light source to said first position on the basis of detection by said position detecting system, and detecting light beam from said first position by said first light receiving element to thereby measure the film thickness at said first position;

a second measuring system having a second light source emitting momentary light and a second light receiving element, said second measuring system applying a momentary light from said second light source to an area including or adjacent to said first position, and detecting a light beam from said area by said second light receiving element to thereby measure the film thickness information of said area;

a film thickness distribution measuring portion for obtaining a film thickness distribution of said film layer by using results of measurement obtained by said first measuring system and said second measuring system; and a controlling system for controlling whether or not said polishing by said polishing means is continued, from data obtained by said film thickness distribution measuring portion.

15. An apparatus according to claim 14, wherein at least one of said first measuring system and said second measuring system has correcting means for correcting a value of the measured film thickness, and said correcting means has the measurement of the film thickness of a sample for correction of which the film thickness has been known, executed by using said light source and said light receiving element of said at least one measuring system and in synchronism with the measurement of the film thickness by said at least one measuring system.

16. An apparatus according to claim 14, wherein said film thickness information measured by said second measuring system is a film thickness difference or an average value of said film thickness.

17. An apparatus according to claim 14, wherein said controlling system stops polishing when said film thickness distribution of said film layer comes into a preset range.

18. An apparatus according to claim 14, wherein operations of said first and second measuring systems, said film thickness distribution measuring portion and said controlling system are performed during polishing of surface of said film layer by said polishing means.

19. An apparatus for measuring a film thickness of a film layer provided on a surface of a substrate, comprising:

a position detecting system for detecting a first position on a surface of said film layer; and a first measuring system having a light source emitting a momentary light and a light receiving element, said first measuring system applying, the momentary light from said light source to said first position on the basis of detection by said position detecting system, and detecting the light beam from said first position by said light receiving element to thereby measure a film thickness at said first position.

* * * * *

UNITED STATES PATENT AND TRADEMARK OFFICE

CERTIFICATE OF CORRECTION

PATENT NO. : 6,503,361 B1
DATED : January 7, 2003
INVENTOR(S) : Masaru Nyui et al.

It is certified that error appears in the above-identified patent and that said Letters Patent is hereby corrected as shown below:

Drawings,
Sheet 2, FIG. 2, "BEAN" should read -- BEAM --.

Column 4,
Line 54, "present" should read -- preset --.

Column 5,
Lines 49 and 62, "Wallaston" should read -- Wollaston --.

Column 6,
Line 9, "Wal-" should read -- Wol- --; and
Line 37, "Wallaston" should read -- Wollaston --.

Column 9,
Line 54, "claim 1" should read -- claim 1, --.

Column 11,
Line 18, "light" should read -- a light --.

Column 12,
Line 30, "applying," should read -- applying --.

Signed and Sealed this

Thirtieth Day of March, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,503,361 B1
DATED : January 7, 2003
INVENTOR(S) : Masaru Nyui et al.

It is certified that error appears in the above-identified patent and that said Letters Patent is hereby corrected as shown below:

Drawings,
Sheet 2, FIG. 2, “BEAN” should read -- BEAM --.

Column 4,
Line 54, “present” should read -- preset --.

Column 5,
Lines 49 and 62, “Wallaston” should read -- Wollaston --.

Column 6,
Line 9, “Wal-” should read -- Wol- --; and
Line 37, “Wallaston” should read -- Wollaston --.

Column 9,
Line 54, “claim 1” should read -- claim 1, --.

Column 11,
Line 18, “light” should read -- a light --.

Column 12,
Line 30, “applying,” should read -- applying --.

This certificate supersedes Certificate of Correction issued August 12, 2003.

Signed and Sealed this

Sixth Day of April, 2004

JON W. DUDAS
*Acting Director of the United States Patent and Trademark Office*